United States Patent [19]

England et al.

[11] Patent Number: 5,016,460

[45] Date of Patent: May 21, 1991

[54] DURABLE METHOD FOR PRODUCING FINNED TUBING

[75] Inventors: Jimmy C. England, Ashland, Ky.; John R. Hensley, Huntington, W. Va.; Frederick E. Moehling, Huntington, W. Va.; Everett M. Roberts, Milton, W. Va.; Hugh-Hiram Ruble, Jr., Huntington, W. Va.

[73] Assignee: Inco Alloys International, Inc., Huntington, W. Va.

[21] Appl. No.: 455,239

[22] Filed: Dec. 22, 1989

[51] Int. Cl.[5] ..... B21B 25/00

[52] U.S. Cl. ..... 72/208; 72/42; 72/256; 72/370; 72/371

[58] Field of Search ..... 72/74, 68, 76, 80, 105, 72/111, 256, 274, 283, 260, 370, 208, 42, 44, 371

[56] References Cited

U.S. PATENT DOCUMENTS

| | | | |
|---|---|---|---|
| 2,978,799 | 4/1961 | Benteler | 29/183.5 |
| 3,061,093 | 10/1962 | Edgecombe et al. | 72/42 |
| 3,118,328 | 1/1964 | Issott | 72/208 |
| 3,140,779 | 7/1964 | Dalton et al. | 72/42 |
| 3,289,451 | 12/1966 | Koch et al. | 72/283 |
| 3,422,518 | 1/1969 | French | 72/283 |
| 3,566,651 | 3/1971 | Tlaker | 72/76 |
| 3,813,911 | 6/1974 | Bibighaus | 72/208 |
| 4,095,447 | 6/1978 | Shevchenko et al. | 72/208 |
| 4,216,575 | 8/1980 | Carnavos et al. | 72/370 |
| 4,658,617 | 4/1987 | Peytavin | 72/44 |
| 4,866,968 | 9/1989 | Cellier et al. | 72/208 |

FOREIGN PATENT DOCUMENTS

| | | | |
|---|---|---|---|
| 2626962 | 12/1977 | Fed. Rep. of Germany | 72/371 |
| 212006 | 9/1983 | Japan | 72/208 |
| 173022 | 10/1983 | Japan | 72/256 |
| 108914 | 5/1988 | Japan | 72/256 |
| 1394404 | 5/1975 | United Kingdom | 72/68 |

*Primary Examiner*—Robert L. Spruill

*Attorney, Agent, or Firm*—Blake T. Biederman; Francis J. Mulligan, Jr.

[57] ABSTRACT

The method of the invention produces a method for fabricating a metal tube that contains at least 30 wt % nickel and 10 wt % chromium. The invention utilized an elongated mandral having an oversized diameter and oversized land portions. The oversized land portions project radially outward from the mandrel and extend longitudinally along the mandrel. The valley portions are located between the land portions and extend longitudinally along the mandrel. Oversized diameter internally finned tubing is formed with the mandrel. The oversized diameter internally finned tubing is sent to a finished diameter. The sinking reduces radial spacing between the fins and elongates the oversized diameter internally finned tubing without substantially reducing the height of the fins.

6 Claims, 2 Drawing Sheets

DURABLE METHOD FOR PRODUCING FINNED TUBING

The invention relates to a method of producing finned tubing. More particularly, the invention relates to a method of increasing mandrel life used in producing finned tubing.

BACKGROUND OF INVENTION AND PROBLEM

A process for forming inner diameter finned tubes was developed for fabricating tubing. The tubes were produced by cold working the tube with a tube reducer over a tapered grooved mandrel directly to finished size. The mandrels for the process were specially fabricated of maraging steel at a cost of approximately $3,000 U.S. a piece. One mandrel would produce an average of only three to four units of 50 ft. (15.2 m) tubes of INCOLOY® alloy 800HT® on a half ring die tube reducer, such as a McKay® tube reducer. As the high-strength corrosion resistant alloy was forced over the mandrel, raised portions of the mandrel would eventually be rendered inoperable by galling or cold welding. Extensive galling or cold welding of the mandrel caused the product to have unacceptable interior fins. For this reason, mandrels were required to be replaced after producing an average of only 3 to 4 tubes when using a half ring die tube reducer. A full ring die, such as a tube reducer produced by Wayne, provides less mandrel wear, producing about forty to sixty 50 ft. (15.2 m) tubes per mandrel. The problem with the full ring die is the higher degree of difficulty in machining mandrels and the resulting higher mandrel price than for mandrels for the half ring die design. In addition, full ring die design tube reducers are significantly more expensive machines to purchase than half ring die design tube reducers.

When using a short stroke, half ring die tube reducer, an enormous force is required to cold work alloys containing at least 30 wt % nickel and 10 wt % chromium (percentages of alloy components are given in weight percent). Cold working is especially difficult with internally finned tubes having outer diameters of less than about 4 in. (10.2 cm). Internally finned tubing of this small diameter are especially difficult to form due to the large forces against a relatively small diameter mandrel.

It is an object of this invention to provide a method of producing internally finned tubing in a manner which extends the useful tool life of a mandrel.

SUMMARY OF THE INVENTION

The method of the invention provides a method for fabricating a metal tube that contains at least 30% nickel and 10% chromium by weight. The invention utilizes an elongated mandrel having an oversized diameter and oversized land portions. The oversized land portions project radially outward from the mandrel and extend longitudinally along the mandrel. Valley portions are located between the land portions and extend longitudinally along the mandrel. Oversized diameter internally finned tubing is formed with the mandrel. The internally finned tubing has fins corresponding to the valley portions and depressions corresponding to the oversized land portions. The fins have a height upon forming substantially equal to a finished height. The oversized diameter internally finned tubing is then sunk to a finished diameter. The sinking reduces radial spacing between the fins and elongates the oversized diameter internally finned tubing without substantially reducing the height of the fins.

DESCRIPTION OF PREFERRED EMBODIMENT

Figure 1:
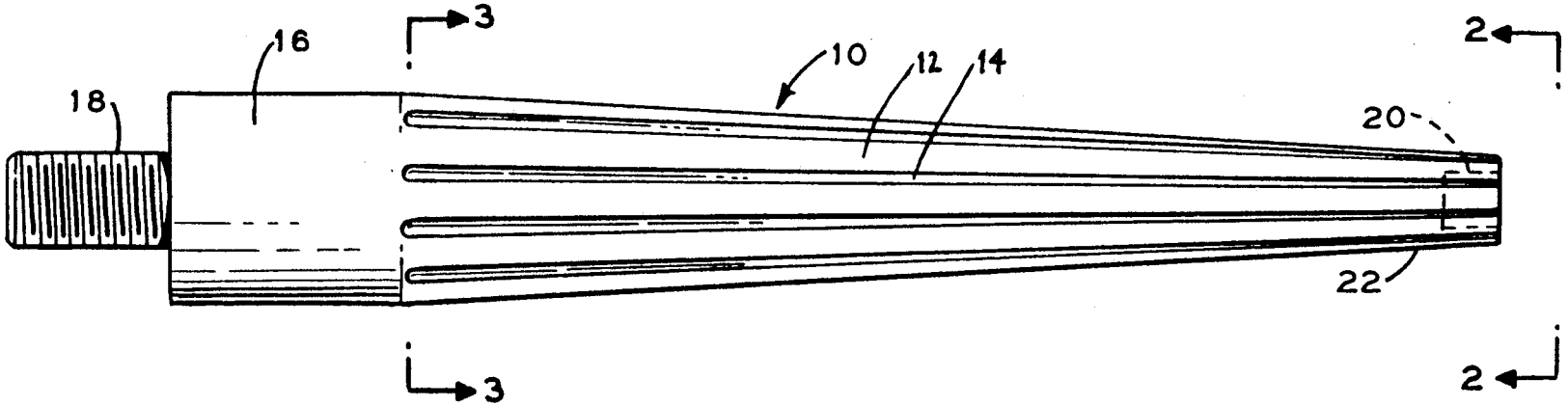
FIG. 1 is a schematic plan view of a mandrel used in the invention in combination with a tube reducer.

Referring to FIG. 1, there is shown an oversized mandrel 10. For purposes of this specification, oversized defines a diameter greater than a finished diameter. Mandrel 10 includes land portions 12 and valley portions 14. The head 16 includes a support member 18. Support cavity 20 (for tube reducing) is located on the tapered end 22 of mandrel 10.

Figure 2:
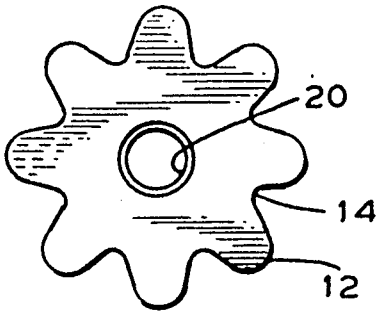
FIG. 2 is an end view taken along line 2—2 of FIG. 1.
Figure 3:
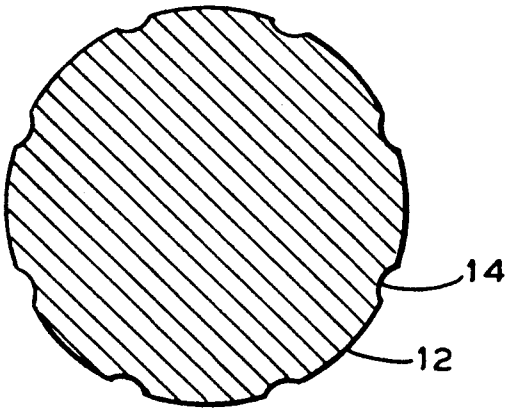
FIG. 3 is a traverse cross section taken along line 3—3 of FIG. 1.

Referring to FIGS. 2 and 3, the oversized land portion 12 and the taper from the tapered end to the head 16. The depth of valley portions 14 gradually increases from head 16 in the direction of tapered end 22.

Figure 4:
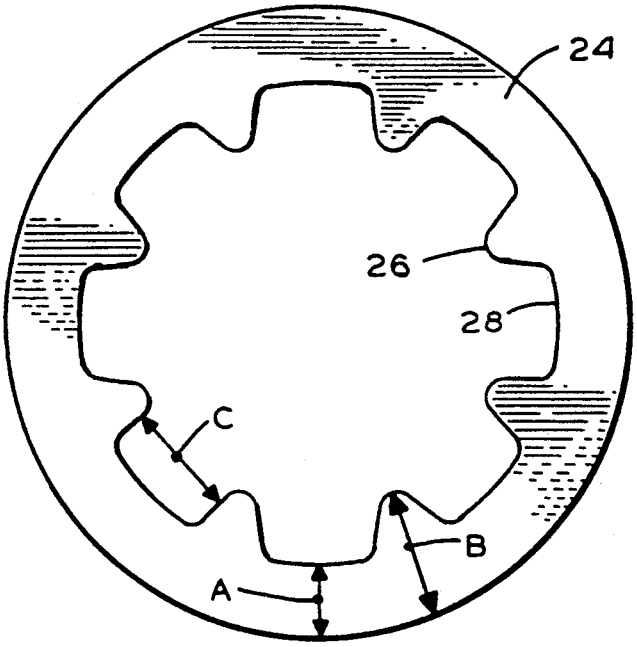
FIG. 4 is a schematic cross section of an oversized diameter internally finned tubing formed by the method of the invention.

Referring to FIG. 4, an oversized internally finned tube 24 formed with mandrel 10. Oversized tube 24 has fins 26 and radially overspaced depressions 28. Fins 26 correspond to valley portion 14 of FIGS. 1-3 and depressions 28 correspond to land portions 12 of FIGS. 1-3. Fins 26 have a height approximately equal to a finished height. Fin height is measured by subtracting nominal wall thickness (A) from the thickness from fin tip to outer diameter (O.D.) (B). Fins 26 are radially overspaced. Radial spacing between the fins is measured by (C), which is measured in degrees.

Figure 5:
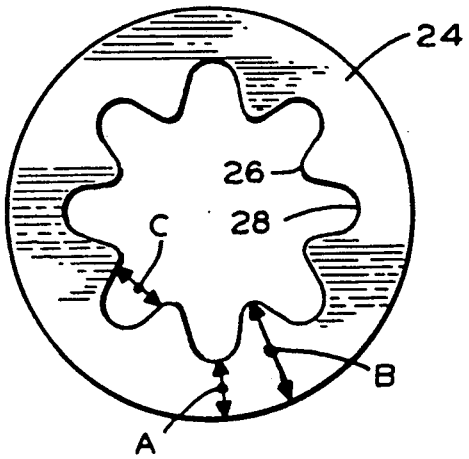
FIG. 5 is a schematic cross section of finished internally finned tubing formed by the method of the invention.

Referring to FIG. 5, the oversized diameter pipe is then sunk to a finished O.D. For purposes of this specification, sinking is defined as a reduction in tube diameter without the use of a mandrel. For example, sinking may comprise drawing a tube through a die without the use of a mandrel. Sinking reduces the radial spacing (C) between the fins 26, elongates the internally finned tubing 24, reduces pipe width (A), the width of fin tip to O.D. (B) and only slightly reduces fin height. The sinking step of the invention avoids the high stresses placed on mandrels, especially when using short stroke tube reducers or small diameter mandrels.

To form oversized internally finned tubing with a tube reducer, the metal tube and mandrel are inserted between two opposing roller dies of a tube reducer. The roller dies are then reciprocated over the tube to form the oversized internally finned tubing. For further general information regarding tube reducing, see *Metals Handbook*, 1948 edition, ASM, pages 873-874, and *The Making, Shaping and Treating of Steel*, 9th edition, 1971, U.S. Steel Corporation, pages 908-910. The tube reducing method of the invention was utilized with 0.562 in (14.3 mm) thick, 3.5 in. (8.99 cm) outer diameter (O.D.) tube. The tube tested was Incoloy® alloy 800HT® having a composition as follows by weight percent: 30.0-35.0 Ni, 19.0-23.0 Cr, 0.06-0.10 C, 0.0-1.50 Mn, 0.0-0.15 S, 0.0-1.0 Si, 0.0-0.75 Cu, 0.15114 0.60 Al, 0.15–0.60 Ti, 0.85–1.20 (Al plus Ti), and the balance Fe. Incoloy® alloy 800HT® is a difficult alloy to cold work due to its high strength and high tendency to cold weld. During the first reduction with a half ring die tube reducer, the diameter was reduced to 2 §in. (6.67 cm). Tubes were fed at a distance of 0.25 in. (0.635 cm) per stroke to the tube reducer, which operated at a rate between 40 and 60 strokes per minute. Preferably, a chlorinated, pigmented oil such as castor oil is used as a lubricant. Additionally, the outer surface is preferably plated with copper for additional lubrication. Representative tube size measurements of the oversized tube are shown in Table 1.

TABLE 1

| | Tube 1 | | | Tube 2 | | |
|---|---|---|---|---|---|---|
| Fin Number | Fin Wall Thickness | Wall Thickness | Fin Height | Fin Wall Thickness | Wall Thickness | Fin Height |
| 1 | 0.473 | 0.241 | 0.228 | 0.466 | 0.252 | 0.212 |
| | (12.0) | (6.12) | (5.79) | (11.8) | (6.40) | (5.38) |
| 2 | 0.468 | 0.240 | 0.229 | 0.461 | 0.247 | 0.212 |
| | (11.9) | (6.10) | (5.82) | (11.7) | (6.27) | (5.38) |
| 3 | 0.470 | 0.243 | 0.227 | 0.455 | 0.241 | 0.211 |
| | (11.9) | (6.17) | (5.77) | (11.6) | (6.12) | (5.36) |
| 4 | 0.473 | 0.250 | 0.223 | 0.450 | 0.239 | 0.210 |
| | (12.0) | (6.35) | (5.66) | (11.4) | (6.07) | (5.33) |
| 5 | 0.474 | 0.252 | 0.223 | 0.447 | 0.242 | 0.207 |
| | (12.0) | (6.40) | (5.66) | (11.4) | (6.15) | (5.26) |
| 6 | 0.475 | 0.252 | 0.223 | 0.457 | 0.249 | 0.212 |
| | (12.1) | (6.40) | (5.66) | (11.6) | (6.23) | (5.38) |
| 7 | 0.474 | 0.251 | 0.232 | 0.467 | 0.256 | 0.215 |
| | (12.0) | (6.38) | (5.89) | (11.9) | (6.50) | (5.46) |
| 8 | 0.480 | 0.246 | 0.230 | 0.468 | 0.257 | 0.212 |
| | (12.2) | (6.25) | (5.84) | (11.9) | (6.53) | (5.38) |

* No parenthesis indicates inches, parenthesis () indicates millimeters.

The oversized tube was then sunk (drawing through a die without a mandrel) to a finished diameter. Tube 1 was sunk to a finished O.D. of 2.025 in. (5.118 cm) and Tube 2 was sunk to a finished O.D. of 2.011 in. (5.108 cm). The tube fin measurements after sinking is below in Table 2.

TABLE 1

| | Tube 1 | | | Tube 2 | | |
|---|---|---|---|---|---|---|
| Fin Number | Fin Wall Thickness | Wall Thickness | Fin Height | Fin Wall Thickness | Wall Thickness | Fin Height |
| 1 | 0.471 | 0.263 | 0.206 | 0.447 | 0.254 | 0.189 |
| | (12.0) | (6.68) | (5.23) | (11.4) | (6.45) | (4.80) |
| 2 | 0.462 | 0.260 | 0.201 | 0.441 | 0.245 | 0.192 |
| | (11.7) | (6.60) | (5.10) | (11.2) | (6.22) | (4.88) |
| 3 | 0.464 | 0.261 | 0.203 | 0.431 | 0.239 | 0.189 |
| | (11.8) | (6.62) | (5.16) | (10.9) | (6.07) | (4.80) |
| 4 | 0.455 | 0.263 | 0.193 | 0.427 | 0.239 | 0.188 |
| | (11.6) | (6.68) | (4.90) | (10.8) | (6.07) | (4.78) |
| 5 | 0.467 | 0.267 | 0.204 | 0.435 | 0.248 | 0.192 |
| | (11.9) | (6.78) | (5.18) | (11.0) | (6.30) | (4.88) |
| 6 | 0.472 | 0.270 | 0.204 | 0.449 | 0.263 | 0.194 |
| | (12.0) | (6.86) | (5.18) | (11.4) | (6.68) | (4.93) |
| 7 | 0.475 | 0.271 | 0.204 | 0.461 | 0.264 | 0.198 |
| | (12.1) | (6.88) | (5.18) | (11.7) | (6.70) | (5.03) |
| 8 | 0.477 | 0.267 | 0.208 | 0.454 | 0.263 | 0.191 |
| | (12.1) | (6.78) | (5.28) | (11.5) | (6.68) | (4.85) |

* No parenthesis indicates inches, parenthesis () indicates millimeters.

Tube 1 had an initial fin height of 0.226 in. (5.74 mm) prior to sinking and a fin height of 0.203 in. after sinking. Tube 2 had an initial fin height of 0.211 in. (5.36 mm) and a fin height of 0.192 in. (4.88 mm) after sinking. The average loss of fin height from sinking was only about 0.02 in. (0.51 mm). Mandrels of this method were capable of producing between fifty and seventy-five 50 ft (15.2 m) tubes until the mandrel failed or produced product out of specification.

Alternatively, the oversized tube may be formed by extrusion between a die and a mandrel. When extruding metal, a mandrel designed for use in extrusion as known in the art is used. An extrusion mandrel is preferably constructed of a tool steel such as H 13C. Additionally, the tapered end is less tapered. A typical extrusion mandrel is only tapered a few thousandths of an inch (0.005–0.010 centimeter). The extrusion mandrel is attached at one end to the ram. To extrude alloys of at least 30% nickel and 10% chromium, a trepanned 11–12 (27.9–30.5 cm) diameter billet is preheated to between about 2100° F. to 2200° F. (1149° C. to 1204° C.). The preheated trepanned billet is inserted surrounding the mandrel. Molten glass lubricant is used with a 6,000 tons (5,440 metric tonne) extrusion press. The extrusion method directly produces internally finned oversized diameter tubing. The oversized tubing is then pickled to remove any glass and sunk to a finished diameter.

Although straight, longitudinal internal fins significantly increase heat transfer properties of tubing. Specialized tube applications, such as ethylene furnaces, may require rifled fins for a further increase of heat transfer properties. Optionally, internally finned tubes either oversized or finished diameter may be inserted into a tube stretcher/detwister. A tube is first stretched to a stress close to, but below the yield point of the tube. Torsion forces are then exerted on the tube to cause the fins to twist. The torsion forces required to twist the tube are reduced, because the tubes are already close to the yield point. The degree of fin rifling may then be selected in accordance with the material's capacity for further cold work. Preferably, the tubes are heat treated after sinking and prior to a twisting operation to relieve residual stress.

The method of the invention was especially successful with INCOLOY ® alloy 800HT ®. The method of the invention is particularly useful for difficult to work alloys such as alloys with greater than 30 wt % Ni and 10 wt % Cr. The method of the invention would be particularly useful for alloys which have a strong tendency to gall or cold weld such as nickel-iron alloys, iron-nickel alloys and for more difficult to work nickel-iron-chromium alloys such as INCONEL ® alloys 600, 601, 617, 625 and 718. An example of these difficult to work alloys in addition to Incoloy ® alloy 800HT ® is those alloys having by weight 10–30 Cr, 0.0–25 Fe, 0.0–0.5 C, 0.0–1.0 Mn, 0.0–0.15 S, 0.0–0.5 Si, 0.0–1.0 Cu, 0.0–1.7 Al, 0–15 Co and the balance Ni where Ni is greater than 30.0. The method of the invention has saved thousands of dollars in mandrel cost. The tube reducing method of the invention allows a less expensive half ring die to operate as effectively as more expensive full ring die designs. Presently, the tube reducing method is favored over the extrusion method. However, both methods facilitate increased mandrel life.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method of making operable diameter internally finned tubing comprising the steps of:

(a) placing a metal tube containing at least 30 wt % nickel and 10 wt % chromium at least partially over an elongated mandrel having an oversized diameter, oversized land portions projecting radially outward from said mandrel and extending longitudinally along said mandrel, and valley portions located between said land portions extending longitudinally along said mandrel, (b) inserting said metal tube and said oversized mandrel between a pair of opposed roller dies in a tube reducer, (c) reciprocating said roller dies over said metal tube at a stroke rate of at least 40 strokes per minute and a feed rate of at least 0.635 cm per stroke to form oversized diameter internally finned tubing with said oversized mandrel, said internally finned tubing having fins corresponding to said valley portions and radially overspaced depressions corresponding to said overspaced land portions, said fins having a height substantially equal to a finished height, and having said depressions laterally overspaced, and (d) sinking said oversized diameter internally finned tubing to a finished diameter to reduce radial spacing between said fins and to elongate said oversized diameter internally finned tubing in a manner which does not substantially reduce the height of said fins.

2. The method of claim 1 wherein said finished outer diameter is less than about 10.2 cm.

3. The method of claim 1 including twisting said metal tube to impart a twist to the fins therein.

4. The method of claim 1 wherein said roller dies are half ring dies.

5. The method of claim 4 wherein said metal tube is copper plated and lubricated with chlorinated oil.

6. The method of claim 5 wherein said metal tube contains by weight percent, 30 to 35 nickel, 19 to 23 chromium, 0.06–0.10 carbon, 0 to 1.5 manganese, 0 to 0.15 sulfur, 0 to 1 silicon, 0 to 0.75 copper, 0.15 to 0.60 aluminum, 0.15 to 0.60 titanium, 0.85 to 1.20 aluminum plus titanium and balance iron.

* * * * *